US007452429B2

(12) United States Patent
Boselli et al.

(10) Patent No.: US 7,452,429 B2
(45) Date of Patent: Nov. 18, 2008

(54) PRODUCTS MADE OF AL-ZN-MG-CU ALLOYS WITH AN IMPROVED COMPROMISE BETWEEN STATIC MECHANICAL CHARACTERISTICS AND DAMAGE TOLERANCE

(75) Inventors: Julien Boselli, Grenoble (FR); Fabrice Heymes, Veyre-Monton (FR); Frank Eberl, Grenoble (FR); Timothy Warner, Voreppe (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 10/873,635

(22) Filed: Jun. 23, 2004

(65) Prior Publication Data

US 2005/0058568 A1 Mar. 17, 2005

Related U.S. Application Data

(60) Provisional application No. 60/480,743, filed on Jun. 24, 2003.

(51) Int. Cl.
*C22C 21/10* (2006.01)
*C22F 1/053* (2006.01)

(52) U.S. Cl. ..... 148/417; 420/532; 148/690

(58) Field of Classification Search ..... 148/417, 148/690; 420/532, 552, 553
See application file for complete search history.

(56) References Cited

U.S. PATENT DOCUMENTS

| | | | | |
|---|---|---|---|---|
| 4,569,703 | A * | 2/1986 | Baba et al. | 148/417 |
| 4,747,890 | A | 5/1988 | Meyer | |
| 4,954,188 | A * | 9/1990 | Ponchel et al. | 148/694 |
| 5,312,498 | A * | 5/1994 | Anderson | 148/695 |
| 5,865,911 | A * | 2/1999 | Miyasato et al. | 148/439 |
| 6,027,582 | A * | 2/2000 | Shahani et al. | 148/417 |
| 2001/0039982 | A1* | 11/2001 | Sigli et al. | 148/550 |
| 2002/0121319 | A1* | 9/2002 | Chakrabarti et al. | 148/694 |
| 2005/0006010 | A1* | 1/2005 | Benedictus et al. | 148/552 |

FOREIGN PATENT DOCUMENTS

| | | |
|---|---|---|
| EP | 0257167 | 3/1988 |
| EP | 0589807 | 3/1994 |
| EP | 0876514 | 11/1998 |
| WO | WO-02/052053 | 7/2002 |

OTHER PUBLICATIONS

"ASM Specialty Handbook: Aluminum and Aluminum Alloys", ASM International, 1993, p. 23.*
W.F. Brown et al., Aerospace Materials Handbook, published by CINDAS, 1997.
Abelkis et al., Proceedings of "Fatigue at Low Temperatures", Louisville, KY, May 10, 1983, pp. 257-273.

* cited by examiner

*Primary Examiner*—Roy King
*Assistant Examiner*—Janelle Morillo
(74) *Attorney, Agent, or Firm*—Womble Carlyle Sandridge & Rice, PLLC

(57) ABSTRACT

The present invention relates to an extruded, rolled and/or forged product made of an aluminum alloy. Alloys of the present invention may comprise (by mass):

Zn 6.7-7.5% Cu 2.0-2.8% Mg 1.6-2.2% at least one element selected from the group composed of:

i Zr 0.08-0.20% Cr 0.05-0.25% Sc 0.01-0.50%
Hf 0.05-0.20% and V 0.02-0.20%

Fe+Si<0.20% other elements ≦0.05 each and ≦0.15 total, balance aluminum. Products of the present invention in some embodiments have an improved compromise between static mechanical strength and damage tolerance.

31 Claims, 3 Drawing Sheets

PRODUCTS MADE OF AL-ZN-MG-CU ALLOYS WITH AN IMPROVED COMPROMISE BETWEEN STATIC MECHANICAL CHARACTERISTICS AND DAMAGE TOLERANCE

CROSS REFERENCE TO RELATED APPLICATIONS

The present application claims priority under 35 U.S.C. 119 from U.S. Provisional Application No. 60/480,743 filed Jun. 24, 2003, the content of which is fully incorporated herein by reference in their entireties.

BACKGROUND OF THE INVENTION

1. Field of the Invention

The present invention relates generally to Al—Zn—Mg—Cu type alloys that may possess an improved compromise between static mechanical characteristics and damage tolerance, and structural elements for aeronautical construction including partly finished strain-hardened products made from these alloys.

2. Description of Related Art

It is generally known that when manufacturing partly finished products and structural elements for aeronautical construction, certain required properties generally cannot be optimized at the same time independently of one another. When the chemical composition of the alloy or the parameters of product production processes are modified, several important properties can tend to vary in opposite directions. This is sometimes the case with respect to properties collected under the umbrella term as "static mechanical properties" (particularly the ultimate strength $R_m$ and the yield stress $R_{p0.2}$), and second those properties known as properties relating to "damage tolerance" (particularly toughness and resistance to crack propagation). Some frequently used properties such as fatigue resistance, corrosion resistance, formability and elongation at failure are related to the mechanical properties (or "characteristics") in a complicated and frequently unpredictable manner. Therefore, optimization of all properties of a material for aeronautical construction very often may mean making a compromise between several key parameters.

Al—Zn—Mg—Cu type alloys (belonging to the 7alloys family) are frequently used in aeronautical construction, and particularly in the construction of civil aircraft wings. For example, a sheet metal skin with a high content of 7150, 7055, 7449 alloys is often used for the extrados of wings, and stiffeners made of sections of 7150, 7055 or 7449 alloys can be used. 7150, 7050, 7349 alloys are also used for making fuselage stiffeners. The 7475 alloy is sometimes used for making wing intrados panels, particularly by machining thick plates, while extruded wing intrados stiffeners are typically made of 2xxx type alloys (for example 2024, 2224, 2027).

Some of these alloys have been known for decades, for example, the 7075 and 7175 alloys (zinc content between 5.1 and 6.1% by weight), the 7475 alloy (zinc content between 5.2 and 6.2%), the 7050 alloy (zinc content between 5.7 and 6.7%), the 7150 alloy (zinc content between 5.9 and 6.9%) and the 7049 alloy (zinc content between 7.2 and 8.2%). The compromise between toughness and yield strength is different for each of these alloys.

Patent application EP 0 257 167 A1 describes an alloy developed specifically for making hollow bodies resistant to pressure, by inverse extrusion. The composition of this alloy is as follows (in percent by weight):

| | | | | |
|---|---|---|---|---|
| Zn 6.25-8.0 | Mg 1.2-2.2 | Cu 1.7-2.8 | Zr 0.05 | Fe 0.20 |
| Fe + Si 0.40 | Cr 0.15-0.28 | Mn 0.20 | Ti 0.05 | |

Values of $R_m$=530 MPa, $R_{p0.2}$=480 MPa, and A=15.4% cannot be exceeded for these products in a dissolved and annealed state. An increase in the content of zinc (to 8.0%), Cu (to 2.2%) and Mg (to 2.4%) causes an increase in $R_m$ (to 570 MPa) and $R_{p0.2}$ (to 525 MPa), but these products typically have a low burst strength.

Patent application EP 0 589 807 A1 discloses a pressurized gas cylinder with a composition of Zn 6.9, Cu 2.3, Mg 1.9, Zr 0.11 that shows the following static mechanical characteristics in the L direction in the T73 temper:

$$R_{p0.2}=392\text{ MPa},\ R_m=459\text{ MPa},\ A=15.2\%.$$

U.S. Pat. No. 5,865,911 (Aluminum Company of America) discloses an Al—Zn—Cu—Mg type alloy with the following composition:

Zn 5.9-6.7, Mg 1.6-1.86, Cu 1.8-2.4, Zr 0.08-0.15, which is taught as useful for making structural elements for aircraft. These structural elements are optimized to have high mechanical strength, toughness and fatigue strength.

Published patent application WO 02/052053 (the '053 application') describes three Al—Zn—Cu—Mg type alloys with the following composition:

| | | | |
|---|---|---|---|
| Zn 7.3 | Cu 1.6 | Mg 1.5 | Zr 0.11 |
| Zn 6.7 | Cu 1.9 | Mg 1.5 | Zr 0.11 |
| Zn 7.4 | Cu 1.9 | Mg 1.5 | Zr 0.11 |

The '053 application also discloses appropriate thermomechanical treatment processes for making structural elements for aircraft.

A 7040 alloy with the following normalized chemical composition is known:

| | | | |
|---|---|---|---|
| Zn 5.7-6.7 | Mg 1.7-2.4 | Cu 1.5-2.3 | Zr 0.05-0.12 |
| Si ≦ 0.10 | Fe ≦ 0.13 | Ti ≦ 0.06 | Mn ≦ 0.04 |

other elements ≦0.05 each and ≦0.15 total.

A 7085 alloy with the following standardized chemical composition is also known:

| | | | | |
|---|---|---|---|---|
| Zn 7.0-8.0 | Mg 1.2-1.8 | Cu 1.3-2.0 | Zr 0.08-0.15 | |
| Si ≦ 0.06 | Fe ≦ 0.08 | Ti ≦ 0.06 | Mn ≦ 0.04 | Cr ≦ 0.04 |

other elements ≦0.05 each and ≦0.15 total.

More recently, it has been observed that reducing the concentration of Cu and Mg compared with a type 7050 alloy (see EP 0 876 514 B1) may be useful. Thus, a compromise between the toughness and mechanical strength can possibly be improved for a thick plate.

SUMMARY OF THE INVENTION

In accordance with the present invention there is provided a strain-hardened product comprising an Al—Zn—Mg—Cu type alloy capable of reaching very high levels of static mechanical strength while having sufficient levels for other important properties, particularly toughness, corrosion resistance and resistance to the propagation of fatigue cracks (cracking).

The present invention in one embodiment comprises an extruded, rolled or forged product comprising an aluminum alloy, wherein the alloy comprises (by mass):

Zn 6.7-7.5% Cu 2.0-2.8% Mg 1.6-2.2% at least one element selected from the group consisting of:

Zr 0.08-0.20% Cr 0.05-0.25% Sc 0.01-0.50%

Hf 0.05-0.20% and V 0.02-0.20%; wherein

Fe+Si<0.20%, and all other elements ≦0.05% each and ≦0.15% total, the remainder being aluminum.

The present invention is further directed to a manufacturing process to obtain such a product.

The present invention is also directed to an aircraft structural element that incorporates at least one product as described above, and particularly a structural element used in the construction of a wing of civil aircraft, such as a stiffener, and in particular a wing intrados stiffener.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

DETAILED DESCRIPTION OF A PREFERRED EMBODIMENT

Figure 1:
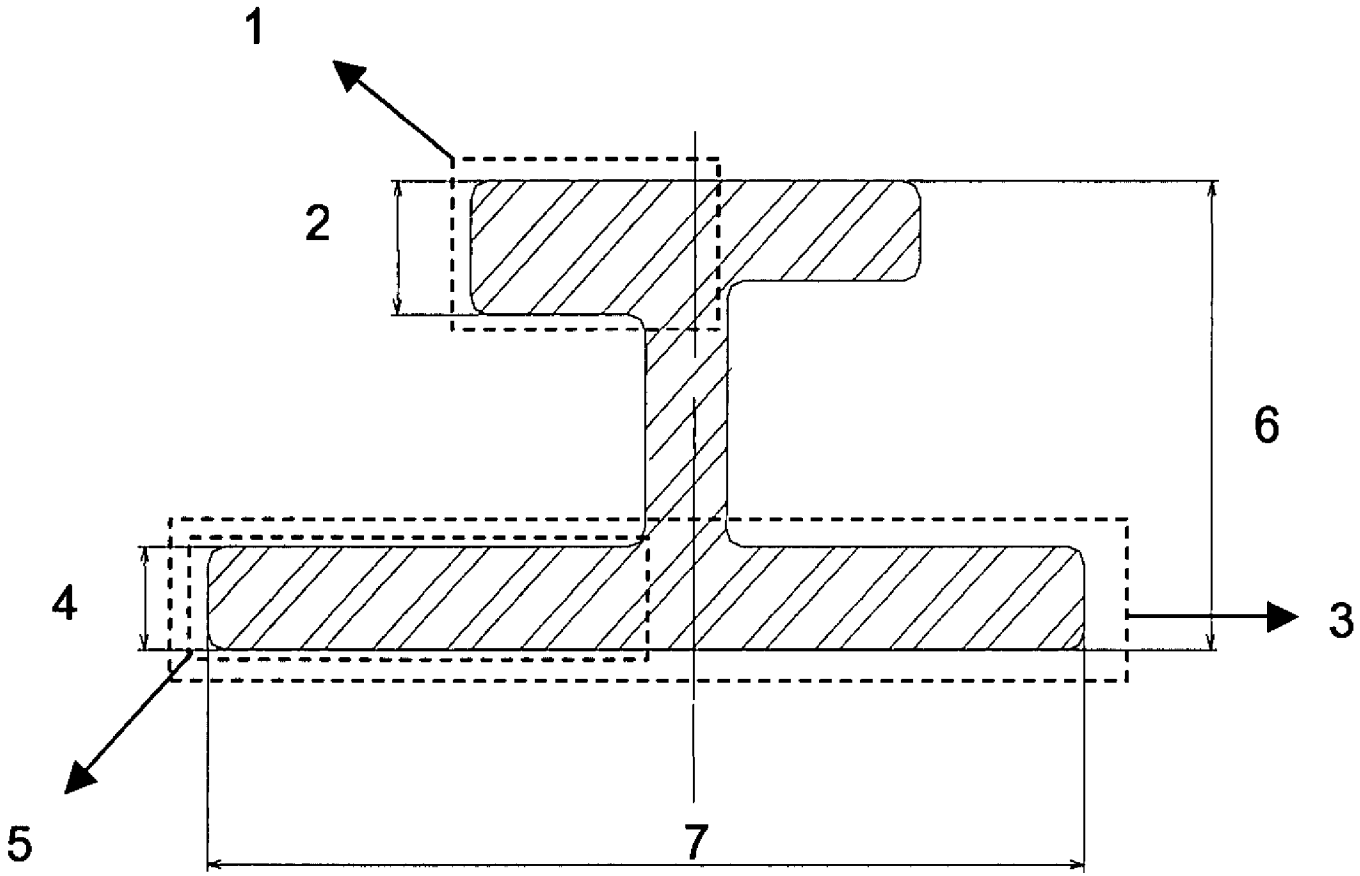
FIG. 1 shows a section of "I"—shape profiles, the manufacture of which is describes in example 1.

Unless mentioned otherwise, all information about the chemical composition of alloys is expressed in percent by mass. Consequently, in a mathematical expression, "0.4 Zn" means 0.4 times the zinc content expressed in percent by mass; this is applicable after making the necessary changes to other chemical elements. Unless mentioned otherwise, all chemical compositions indicated in this description and in the examples were determined on samples obtained by taking a representative sample of liquid metal during casting, followed by solidification of the sampled liquid metal in a mold that enabled good homogeneity of the concentration of elements in the solid. The concentrations of the chemical elements were determined by X-ray spectroscopy on solid or liquid (dissolved) samples. Alloys are named in accordance with the rules of The Aluminum Association. The metallurgical tempers are defined in European standard EN 515. Unless mentioned otherwise, static mechanical characteristics, in other words the ultimate strength $R_m$, the yield stress $R_{p0.2}$ and elongation at failure A, were determined by a tension test according to standard EN 10002-1, sampling and orientation of test pieces being defined in standard EN 485-1. Compression yield stress was determined according to ASTM E9. Plane strain fracture toughness $K_{IC}$ was determined according to ASTM E 399. The R curve was determined according to ASTM E 561-98. The critical stress intensity factor $K_C$, i.e. the stress intensity factor at which the crack get unstable, was computed from the R-curve. The strain intensity factor $K_{app}$ was determined according to ASTM E561-98. Exfoliation corrosion was determined by an EXCO type test according to ATSM G34.

Unless otherwise mentioned, the definition of European Standard EN 12258-1 are used in the present specification. The expression "sheet" however refers to rolled products of any thickness. The term "extruded product" includes so-called "drawn" products, in other words products produced by extrusion followed by drawing. It also includes drawn wire.

The term "structural member" or "structural member" refers to a member used in mechanical construction, for which static or dynamic mechanical properties have a specific importance for the behaviour and integrity of the structure. These are typically mechanical elements the failure of which may lead to a safety hazard. In an aircraft, such structural members include : elements which form the fuselage (such as fuselage skin, stringers, bulkheads), circumferential frames, wings (such as wing skin, stiffeners, stringers, ribs, spars), empennage (such as vertical and horizontal stabilisers), floor beams, seat tracks, doors.

The duration of aging treatments is defined by reference to an equivalent duration at a reference temperature (such as 160° C.). The following equation is used:

$$TEQ(160^\circ\ \text{C.}) = \exp\left[\frac{Q}{R}\left(\frac{1}{(160+273)}\frac{1}{(T_{réel}+273)}\right)\right]\times t_{réel}$$

wherein TEQ(160° C.) is the equivalent duration at 160° C. corresponding to an ageing treatment of a duration of $t_{réel}$ at a temperature of $T_{rée}$ (in ° K.), where Q represents the activation energy of 132000 kJ/mol, and R=8.31 kJ/mol/(° K.).

According to one embodiment the invention, certain objectives were achieved by i) making a fine adjustment of the content of alloy elements and ii) modifying the heat treatment conditions, particularly the homogenization of as-cast products, and dissolution and annealing of products obtained by hot transformation.

A first step in an exemplary process according to the instant invention is to prepare an alloy with the following preferable composition:

Zn 6.7-7.5 (more preferably: 6.9-7.3);

Cu 2.0-2.8 (more preferably: 2.2-2.6);

Mg 1.6-2.2 (more preferably: 1.8-2.0);

at least one element selected from the group consisting of Zr 0.08-0.20, Cr 0.05-0.40, Sc 0.01-0.50, Hf 0.05-0.60, and V 0.02-0.20; wherein Fe+Si<0.20 and preferably <0.15;

other elements <0.05 each and <0.15 total, the remainder being aluminum.

For the purposes of this invention, the content of elements in the alloy should advantageously not significantly exceed their solubility limit, since if they do, the persistence of intermetallic phases would be observed during dissolution, which in turn can reduce damage tolerance. For a given magnesium content, the copper content may be increased if desired to a level fairly close to the solubility limit that depends on the magnesium content. Thus, a composition in which 3.8<Cu+Mg<4.8 will be preferred, and 4.0<Cu+Mg<4.7 or 4.1<Cu+Mg<4.7 may be even better in some embodiments.

If the magnesium content is less than about 1.6%, there may be a risk of cracks being formed during casting, and a minimum content of about 1.7% or even 1.8% is preferred in some embodiments. The Cu/Mg ratio is advantageously in some embodiments at least 1.0 in order to obtain a good compromise between properties, and particularly good damage tolerance, but it preferably does not exceed 1.5 otherwise castability may not be acceptable. A value between 1.1 and 1.5, and even more preferentially between 1.1 and 1.4 is preferred.

It has been observed that acceptable toughness properties are no longer obtained if the magnesium content is more than about 2.2%.

In one advantageous embodiment of the invention, the magnesium and copper contents are chosen such that 4.2<Cu+Mg<4.7 and Cu/Mg is between 1.15 and 1.45.

The addition of 0.08-0.20% of zirconium tends to limit recrystallization. This function may also be fulfilled by other elements such as chromium (0.05-0.40%), scandium (0.01-0.50%), hafnium (0.05-0.60%) and/or vanadium (0.02-0.20%). A Zr content not exceeding 0.15% is preferred in some cases to minimize or avoid the formation of primary phases. When several of these anti-recrystallizing elements are added, the sum is limited by the appearance of the same phenomenon. In one advantageous embodiment, only zirconium is added. Chromium is particularly suitable for thin products.

0.8% of manganese can also be added if desired as an anti-recrystallizing agent. In any case, it is preferable if the sum of anti-recrystallizing elements preferably does not exceed about 1%.

An alloy of the present invention can be cast using any technique known to those skilled in the art to obtain an unwrought product, such as an extrusion billet or rolling plate. Such an unwrought product is then preferably homogenized. The purpose of a homoginazation heat treatment is at least three fold: (i) to dissolve coarse soluble phases formed during solidification (ii), to reduce concentration gradients to facilitate the dissolution step and (iii) to precipitate dispersoids in order to limit/eliminate recrystallisation phenomena during the dissolution step. It has been observed that an alloy according to the invention possesses a particularly low end of solidification temperature compared with 7040, 7050 or 7475 type alloys. The same is true with respect to temperatures above which partial fusion of the alloy is observed at thermodynamic equilibrium (that is, the "solidus" temperature). For these reasons, homogenization at a single temperature may cause a risk of burning and may not cause adequate dissolution of the particles. Conducting a homogenization, preferably in at least two steps, provides a method for reducing such a risk and generally improves the result. In one preferred embodiment, homogenization is conducted in two steps, with a first step between about 452 and about 473° C., typically for between about 4 and about 30 hours (preferably between about 4 and about 15 hours), followed by a second step between about 465 and about 484° C. and preferably between about 467 and about 481° C., typically for a duration of between about 4 and about 30 hours (preferably between about 4 and 16 hours). In one particular embodiment, a first step is carried out between about 457 and about 463° C., and a second between about 467 and about 474° C.

In another embodiment, a first homogenization step can be longer, for example, on the order of up to about 24 hours.

In another embodiment, homogenization is performed in only one step, with an increase in temperature of less than 200° C./h, and preferably between 20 and 50° C./h until a temperature between preferably 465 and 484° C. (and more preferably between 471 and 481° C.) is reached.

Homogenization can also be done in three or more steps if desired for any reason.

The unwrought product is then transformed hot to produce extruded products (particularly bars, tubes or sections), hot rolled plates and/or forged parts. Extrusion is preferably done at a die temperature of between about 380 and about 430° C., and even more preferably between about 390 and about 420° C., by any suitable process known to those skilled in the art, such as by direct extrusion and/or by inverse extrusion. In this way, it is possible to obtain extrusions in which the thickness of the large grain skin layer of an extruded product obtained is preferably not more than about 3 mm thick at any point, and preferably the thickness thereof should be limited to about 1 mm, particularly in the case of thinner extruded products.

Hot transformation may possibly be followed by cold transformation if desired for any reason. For example, extruded and cold drawn tubes can be made. It would also be possible to envisage one or several cold rolling passes in the case of rolled products. Cold rolling is normally not considered useful for rolled products more than about 10 mm thick, for which the composition envisaged within the present invention is particularly suitable.

Products obtained are then preferably solutionized, i.e. submitted to a solution heat treatment. In one preferred embodiment of the invention, the temperature is increased continually for a period of between about 2 and about 6 hours, and preferably for about 4 hours, until the temperature is between about 470 and about 500° C. (preferably not exceeding about 485° C.), and preferably between about 474 and about 484° C., and even more preferably between about 477 and about 483° C. The product is advantageously maintained at such a temperature for between about 1 and about 10 hours, and preferably for about 2 to 4 hours. The products are then advantageously quenched, preferably in a liquid quenching medium such as water, wherein the temperature of the liquid preferably does not exceed about 40° C.

Products of the present invention can then be subjected, if desired, to controlled stretching with a permanent elongation preferably of the order of 1 to 5%, and preferably 1.5 to 3%.

The products are then advantageously annealed, which may have a significant influence on the final properties of the product. It has been observed that annealing with two plateaus may give particularly advantageous results. However, annealing can also be done in three or more steps, or ramp annealing is also possible. Or annealing can be done in a single step.

For a two-step process, a first plateau of preferably between about 110° C. and about 130° C. is suitable. In one advantageous embodiment of this invention, the first plateau is between about 115° C. and about 125° C. For this preferred temperature range, the duration of the plateau advantageously corresponds to an equivalent duration TEQ(160° C.) between about 0.1 and about 2 h, and preferably between about 0.1 and about 0.5 hours. The second plateau is advantageously between about 150 and about 170° C. It was observed that, if the objective was to optimize the compromise between $R_{0.2}$ and $K_{app}$, the duration of the anneal TEQ(160° C.) is advantageously between about 4 and about 16 hours, and preferably between about 6 and about 12 hours. If on the one hand, the objective is to optimize the compromise between $R_{0.2}$ and $K_{IC}$, a second longer plateau at a temperature of between about 150° C. and about 170° C. may be preferable, for example a TEQ(160° C.) between about 16 and about 30 hours. In one advantageous embodiment, the second plateau is made at a temperature of about 160° C. for about 24 hours.

In a first particular embodiment, the temperature of the second plateau is between about 155 and about 165° C. It may be particularly important in some cases to control the duration of this second plateau in order to positively affect the final properties of the product. In one particularly advantageous embodiment, the second plateau is between about 157 and about 163° C., and its duration is between about 6 and about 10 hours. In another particular embodiment of the invention, the second plateau takes place at a slightly lower temperatures, between about 150 and about 160° C.

If a single plateau annealing is envisaged, the temperature used can advantageously be on the order of about 115 to about 145° C. for a duration on the order of about 4 to about 50 hours, for example about 48 hours at about 120° C. For example, an equivalent treatment time TEQ (160° C.) on the order of about 0.6 to about 1.20 hours can be used. These single-plateau treatments can potentially produce products in the T6 temper.

For extruded profiles, static mechanical characteristics are typically measured in the longest leg of the section. The same is true for samples taken for corrosion measurements. Samples used to evaluate damage tolerance are taken from a sufficiently wide flat area that includes the longest leg when possible. For plates, samples are taken for measuring static mechanical characteristics at the depth recommended by standard EN 485-1: 1993 (clause 6.1.3.4), which is incorporated herein by reference.

A process according to the present invention is adapted to produce products that have particularly attractive characteristics for aeronautical construction. These products may be in any form, such as metal plates, particularly thick plates, or sections, or forged parts. More particularly, the present invention can be used to make thick sections that can be used, for example, as wing stiffeners. These products preferably have a yield stress $R_{p0.2(L)}$ equal to at least about 550 MPa and preferably at least about 580 MPa, and a value of $K_{app(L-T)}$ measured according to ASTM E 561-98 (incorporated herein by reference) on a "centre-crack tension panel" (also called "middle-cracked tension panel") type test piece with a width W=100 mm of at least about 75 MPa√m, and preferably at least about 78 MPa√m and even more preferably at least about 80 MPa√m. Those skilled in the art will know that the choice of the width W of the test piece affects the resulting value of $K_{app}$.

An important advantage of a product according to the invention is the fact that the value of $K_{app(L-T)}$ determined as described above is approximately the same at about 20° C. and at about −50° C., knowing that −50° C. is a typical ambient temperature during the flight of a civil jet aircraft. More precisely, this value of $K_{app(L-T)}$ generally does not reduce by more than about 3% as the temperature changes from about 20° C. to about −50° C. In one preferred embodiment of this invention, the value $K_{aap(L-T)}$ is reduced only in a small amount, or even is not reduced at all. It is known that the toughness decreases with temperature in some alloys in the 7xxx series. For example, it has been described that the toughness of 7475 T7651 plates drops by 25% (determined from R curves on panels with thickness B=6 mm in the L-T direction) between about 20° C. and about −50° C. (see P. R. Abelkis et al., Proceedings of "Fatigue at Low Temperatures", Louisville, Ky., May 10 1983, pages 257-273 (published by ASTM) and incorporated herein by reference). Under the same conditions, the values $K_{IC}$ or $K_q$ for thick plates made of 7050 T6451 drop in the L-T and T-L direction by at least 5% (see W. F. Brown et al., Aerospace Materials Handbook, published by CINDAS (USAF CRDA Handbook Operation, Purdue University, 1997) incorporated herein by reference. A drop in the value of $K_{IC}$ has also been observed for thick plates made of 7075 T7351, 7475 T 7351, T 7475 T 7651, and under-annealed 7475; this drop is of the order of 2% to 10%. Although it is known that the static mechanical characteristics $R_{p0.2}$ and $R_m$ of alloys in the 7xxx series tend to increase when the temperature drops from about 20° C. to about −50° C. (which provides additional safety of the structure at this temperature), the drop in the toughness of alloys in the 7xxx series according to the state of the art should generally be taken into account when designing structural elements. The toughness of a product according to the invention preferably does not drop significantly (in other words, no more than about 2%) at low temperature.

In one advantageous embodiment of the present invention, the product comprises a wing intrados stiffener with one or more of the following properties (measured at mid-thickness and at a temperature of about 20° C.):

Ultimate strength $R_{m(L)}$ equal to at least about 585 MPa, a yield stress $R_{p0.2(L)}$ as measured by a tension test and by a compression test equal to at least about 555 MPa, elongation at failure $A_{(L)}$ equal to at least about 9%, the measured $K_{app(L-T)}$ value for W=100 mm equal to at least 88 MPa√m, fatigue resistance (fatigue crack growth resistance) $\Delta_{KL-T}$ equal to at least about 27 MPa√m at R=0.1 and a crack propagation rate of about $2.5\times10^{31\ 3}$ mm/cycle, fatigue resistance equal to at least about $10^5$ cycles at R=0.1, $K_t$=3 and $\sigma_{max}\times22$ ksi (151.7 MPa), resistance to exfoliation corrosion equal to at least about EB (and preferably at least about EA), and crack propagation in the S-L direction in a corrosive medium (determined by the DCB (double cantilever beam) method according to EN ISO 7539-6) incorporated herein by reference, of not more than about $10^{-8}$ m/s.

The invention can be used, for example, to obtain a product that has at least one set of the following properties (measured at about 20° C.):

(a) a yield stress $R_{p0.2(L)}$ equal to at least about 480 MPa (and preferably at least about 500 MPa), an ultimate strength $R_{m(L)}$ equal to at least about 530 MPa (and preferably at least about 555 MPa) and a KIc (L-T) equal to at least about 36 MPa√m (and preferably at least about 40 MPa√m and even better at least about 44 MPa√m);

(b) a yield stress $R_{p0.2(L)}$ equal to at least about 550 MPa (and preferably at least about 580 MPa, and even more preferably at least about 600 MPa) and a measured $K_{app(L-T)}$ with W=100 mm equal to at least about 80 MPa√m (and preferably at least about 83 MPa√m and even more preferably at least about 87 MPa√m);

(c) a yield stress $R_{p0.2(L)}$ equal to at least about 550 MPa (and preferably at least about 580 MPa) and a crack propagation rate da/dn not exceeding about $3\times10^{-3}$ nm/cycle (and preferably not exceeding about $2.5\times10^{-3}$ mm/cycle) for ΔK=27 MPa√m;

(d) a yield stress $R_{p0.2(L)}$ equal to at least about 550 MPa (and preferably at least 580 MPa), an ultimate strength $R_{m(L)}$ equal to at least about 580 MPa (and preferably at least about 600 MPa) and a $K_{app(L-T)}$ measured with W=100 mm equal to at least about 80 MPa√m (and preferably at least 83 MPa√m and even better at least 87 MPa√m);

(e) an ultimate strength Rm(L) equal to at least about 580 MPa (and preferably at least about 600 MPa and even more preferably at least about 620 MPa) and a $K_{app(L-T)}$ measured with W=100 mm equal to at least about 80 MPa√m (and preferably at least about 83 MPa√m and even more preferably at least about 87 MPa√m).

According to one particular embodiment, a product can also have at least one property selected from:

(a) elongation at failure $A_{(L)}$ equal to at least about 9%, and preferably at least about 12%, and/or (b) resistance to exfoliation corrosion measured according to ASTM G34 (incorporated herein by reference) equal to at least about EB.

For comparison, typical properties of intrados wing stiffeners made of an AA 2027 T3511 alloy according to the state of the art are as follows:

$R_{m(L)}$: about 545 MPa, $R_{p0.2(L)}$ in tension: about 415 MPa, $R_{p0.2(L)}$ in compression: about 400 MPa, Elongation at failure $A_{(L)}$: about 16%

$K_{IC(L-T)}$: about 48 MPa$\sqrt{m}$ measure with a CT test piece with W=2B, $K_{app(L-T)}$ (W=100 mm, B=6.35 mm): about 75 MPa$\sqrt{m}$ Resistance to exfoliation corrosion: at least EB.

Therefore, it can be seen that the invention particularly increases the ultimate strength and/or the yield stress, while other typically used properties remain at least comparable. The reduction in the elongation at failure is not a disadvantage for these applications, which do not normally require a particularly high value; while a small disadvantage with respect to a reduction in elongation could theoretically be thought to occur, this is more than compensated for by the concurrent increase in mechanical strength.

A product according to the invention is particularly suitable for virtually any application. A product of the present invention may be suitable, for example, for making structural elements for which the effective width to be considered with regard to sizing for toughness or cracking may be limited by geometric factors of the structure in which these structural elements will be integrated. For example, products of the present invention are useful for designs that effectively limit the panel width outside stiffeners. In this case, an advantageous product according to the present invention will be a product that provides the maximum static mechanical strength while at the same time provides sufficient toughness to ensure that the residual strength of the part in the presence of a crack is limited by the static resistance of the product. Alternatively, a product of the present invention could provide a combination of the maximum static mechanical strength and sufficient toughness, rather than its intrinsic toughness.

One particularly preferred product according to the invention is a wing stiffener obtained by extrusion, for example an intrados stiffener. The invention is also useful for many other applications such as for a fuselage frame.

Extruded products according to the present invention exhibit a recrystallized coarse grain layer between long legs, the thickness of which remains:

a) below 3 mm for any section, or b) below 1.5 mm for sections with a width not exceeding 50 mm, or c) below e/4 mm (where e is the thickness) for sections with a width not exceeding 10mm.

Another advantage of the product according to the invention is the possibility of age forming. This implies that the metal is delivered in an intermediate temper, typically after a first aging plateau. Age forming is possible only with products that undergo artificial aging, which is not the case with products in alloys of the 2xxx series in the T351 temper which are used for wing stiffeners and wing skin.

Due to the compromise of its properties, a product according to the invention is very attractive for applications that require high mechanical strength and also high tolerance to occasional overloads without leading to a sudden failure of the part. Apart from structural elements for aircraft, products according to the invention have been used for making other parts satisfying high safety requirements. For example, tubes for the manufacture of frames, forks and handlebars for cycles (bicycles, tricycles, motorbikes, etc.) and baseball bats, can be made by extrusion, possibly followed by cold drawing. For these applications, it was found advantageous to add a small quantity of scandium and/or hafnium to the alloy, for example between about 0.15 and about 0.60% of scandium and about 0.50% of hafnium. Any suitable manufacturing process can be used that preferably leads to a fibrous tube structure.

The invention will be better understood after reading the following examples, which are in no way limiting.

EXAMPLES

Example 1

Semi-continuous extrusion billet with a diameter of 291 mm were cast (alloy A), with the composition indicated in Table 1. These billets were homogenized in two steps:

1) 13 hours at 460° C.

2) 14 hours at 470° C.

TABLE 1

| Alloy | Zn | Mg | Cu | Fe | Si | Zr | Ti | Mn |
|---|---|---|---|---|---|---|---|---|
| A | 6.75 | 1.9 | 2.6 | 0.08 | 0.05 | 0.12 | 0.03 | 0.01 |

The Cu, Mg and Zn content was determined by chemical analysis after dissolution of a part of the sample, while the other elements were determined by X-ray spectroscopy on the solid.

"I" sections (thickness of the order of 17 mm to 22 mm, width and height of the order of 70 mm to 170 mm) were extruded from scalped billets with a diameter of 270 mm, at a die temperature of between 401 and 415° C., at a rate of about 0.5 m/mm. The sections were put in solution by increasing the temperature continuously for 4 hours up to 481±3° C., and then holding this temperature for 6 hours. The next step was an over-annealing treatment to obtain products in the T76 state. Over-annealing was done in two steps: firstly at 120° C. for 6 hours, then at 160° C. for a variable duration. The products obtained were characterized by determining their static mechanical characteristics ($R_m$, $R_{p0.2}$, A) according to EN 10001-2, their resistance to exfoliation corrosion according to ASTM G34 (the so-called "Exco" test), their resistance to stress corrosion according to ASTM G 47, their crack propagation rate according to ASTM E647 (the "da/dn" test) in the T-L or L-T direction for a value of ΔK of 50 MPa$\sqrt{m}$ and a load ratio R=0.1, and their stress intensity factor $K_{app}$ (so-called "apparent k" parameter). This parameter was calculated using the maximum load measured during the test according to ASTM E561-98 on samples with width W equal to 100 mm, and the initial crack length (at the end of precracking) in the formulas indicated in the standard mentioned.

Table 2 illustrates the influence of the duration of the second annealing step on some properties of the product; the mechanical characteristics having been measured at 20° C.:

TABLE 2

| | Duration of 2nd annealing step | | |
|---|---|---|---|
| | 8 h | 12 h | 24 h |
| TEQ(160° C.) | 8.71 h | 12.71 h | 24.71 |
| EXCO: surface | EA | EA | EA |
| EXCO: T/10 | EB | EB | EB |
| EXCO: T/2 | EA | EA | EB |
| $K_{app(L-T)}$ [MPa√m] (long legs) | 89.3 | 83.0 | 80.2 |
| $K_{IC(L-T)}$ [MPa√m] (long legs) | 38.8 | 40.5 | 43.5 |
| $K_{IC(L-T)}$ [MPa√m] (thick legs) | 45.7 | 42.6 | 46.6 |
| $K_{IC(T-L)}$ [MPa√m] (long legs) | 27.0 | 28.6 | 30.7 |
| $K_{IC(T-L)}$ [MPa√m] (thick legs) | 24.5 | 26.1 | 29.2 |
| $R_{m(L)}$ [MPa] (long legs) | 629 | 616 | 561 |
| $R_{m(L)}$ [MPa] (thick legs) | 646 | 621 | 572 |
| $R_{p0,2(L)}$ [MPa] (long legs) | 604 | 582 | 507 |
| $R_{p0,2(L)}$ [MPa] (thick legs) | 621 | 586 | 519 |
| $A_{(L)}$ [%] (long legs) | 12.6 | 13.2 | 13.9 |
| $A_{(L)}$ [%] (thick legs) | 12.4 | 13.1 | 13.3 |

TEQ(160° C.=: Equivalent annealing time at 160° C.
EXCO: resistance to exfoliation corrosion, determined by the EXCO test on the surface, at 1/10 of the thickness (T/10) and mid-thickness (T/2) in the long leg.
$K_{app(L-T)}$: measured with a CCT test piece (W = 100 mm and B = 6 mm).
$K_{IC(L-T \text{ or } T-L)}$ (long leg): with B = 12.5 mm and W = 25 mm
$K_{IC(L-T \text{ ou } T-L)}$ (branche epaisse): avec B = 15 mm et W = 30 mm It was found that a duration of 8 hours or 12 hours gives very good results.

The toughness $K_{app(L-T)}$ at −50° C. was 87.6 MPa√m for 8 hours of annealing, and 83.5 MPa√m for annealing duration of 24 hours.

For a product for which a second annealing step was carried out at 160° C. for 8 hours, the properties in the LT direction were as follows at 20° C.:

$$R_{p0.2(LT)}=579 \text{ MPa}, R_{m(LT)}=609 \text{ MPa}, A(LT)=12\%$$

Table 3 shows the crack propagation rate measured along the L-T direction with B=7.61 mm W=9.96 mm, R=0.10, and $P_{min}$=600 N and $P_{max}$=6000 N, on samples annealed for 6 hours at 120° C. and 8 hours at 160° C.:

TABLE 3

| ΔK [MPa√m] | da/dn [mm/cycle] at 20° C. | da/dn [mm/cycle] at −54° C. |
|---|---|---|
| 10 | $9.50 \times 10^{-5}$ | $5.74 \times 10^{-6}$ |
| 15 | $4.44 \times 10^{-4}$ | $2.48 \times 10^{-4}$ |
| 20 | $1.01 \times 10^{-3}$ | $6.76 \times 10^{-4}$ |
| 25 | $2.04 \times 10^{-3}$ | $1.10 \times 10^{-3}$ |
| 30 | $3.55 \times 10^{-3}$ | $2.24 \times 10^{-3}$ |

Resistance to constant stress corrosion with σ=300, 350 and 400 MPa in the TL direction was better at 24 days for both types of annealing (second plateau for 8 hours at 160° C. and plateau for 24 hours at 160° C.), see table 4.

TABLE 4

| | Duration of 2nd annealing step | |
|---|---|---|
| | 8 h | 24 h |
| TEQ(160° C.) | 8.71 h | 24.71 |
| σ = 300 MPa | >30 days (6 test pieces) | >30 days (6 test pieces) |
| σ = 350 MPa | >30 days (3 test pieces) | >30 days (3 test pieces) |

TABLE 4-continued

| | Duration of 2nd annealing step | |
|---|---|---|
| | 8 h | 24 h |
| σ = 400 MPa | ≧24 days (3 test pieces) | >30 days (3 test pieces) |

Crack propagation in a corrosive environment (determined by the so-called DCB (double cantilever beam) method according to EN standard ISO 7539-6) was of the order of $5\times10^{-9}$ m/s for a second annealing plateau of 8 hours at 160° C.

Example 2

An alloy was made with the composition indicated in Table 5. Extrusion billets were cast with a diameter of 410 mm. Homogenisation conditions were the same as in example 1. The diameter of the billets obtained after scalping was 390 mm. They were extruded at a temperature between 413 and 425° C. (measured at the die and at the container) with an output speed of 0.65 m/mm, in flats with a section of 279×22 mm.

TABLE 5

| Alloy | Zn | Mg | Cu | Fe | Si | Zr | Ti | Cr | Mn |
|---|---|---|---|---|---|---|---|---|---|
| K | 6.78 | 1.91 | 2.49 | 0.08 | 0.05 | 0.11 | 0.03 | 0.00 | 0.01 |

The products were then put into solution with a temperature rise in 35 minutes up to 479±2° C. with a plateau of 4 hours at this temperature. Quenching was done in cold water. The flats were then tensioned with a permanent elongation of between 1.5 and 3%. Annealing was done in two steps: 6 hours at 120° C.+8 hours at 160° C.

The results of the tension test (on a circular test piece with a diameter of 10 mm, taken from the beginning and from the end of the section, at mid-thickness and at mid-width) are given in Table 6.

TABLE 6

| | $R_{m(L)}$ [MPa] | $R_{p0.2(L)}$ [MPa] | $A_{(L)}$ [%] | $R_{m(TL)}$ [MPa] | $R_{p0.2(TL)}$ [MPa] | $A_{(TL)}$ [%] |
|---|---|---|---|---|---|---|
| mid-width | 631 | 605 | 11.7 | 617 | 592 | 11.5 |
| end | 628 | 599 | 11.9 | 615 | 587 | 10.9 |

Fracture toughness $K_{IC}$ and $K_{app}$ as well as EXCO results were obtained on test pieces taken at half thickness and mid-width at the end of the extruded flat. Test conditions were the same as in example 1. Results are summarized in table 7.

TABLE 7

| | |
|---|---|
| EXCO: surface | EA |
| EXCO: T/2 | EBC |
| $K_{app(L-T)}$ [MPa√m] | 75.4 |
| $K_{IC(L-T)}$ [MPa√m] | 31.0 |
| $K_{IC(T-L)}$ [MPa√m] | 29.7 |

$K_{app(L-T)}$: measured with B = 6 mm
$K_{IC(L-T \text{ or } T-L)}$: with B = 10 mm and W = 20 mm Stress corrosion test pieces were taken at the end of profiles at half thickness at both sides of the mid width. Results of resistance to constant stress corrosion with σ=300, 350 and 400 MPa in the TL direction are listed in table 8. Monitoring of the test pieces was discontinued after 40 days.

TABLE 8

| | |
|---|---|
| Length of the Second Stage of Recovery | 8 h |
| TEQ(160° C.) | 8.71 h |
| σ = 300 MPa | >40j (3 samples) |
| σ = 350 MPa | >40j (3 samples) |
| σ = 400 MPa | ≧33j (3 samples) |

Example 3

Figure 2:
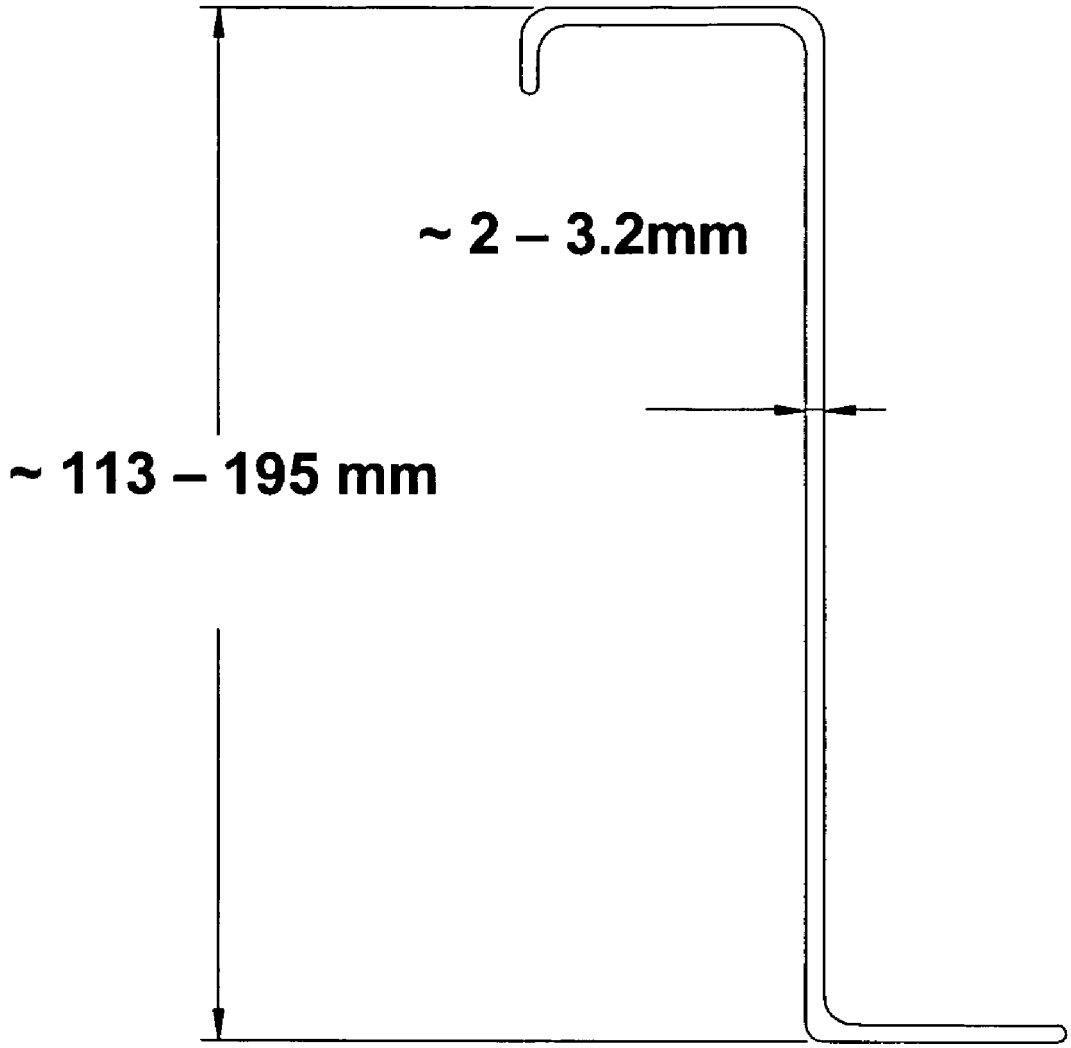
FIG. 2 shows a cross-section through the sections for which manufacturing is described in examples 3 and 4.
Figure 3:
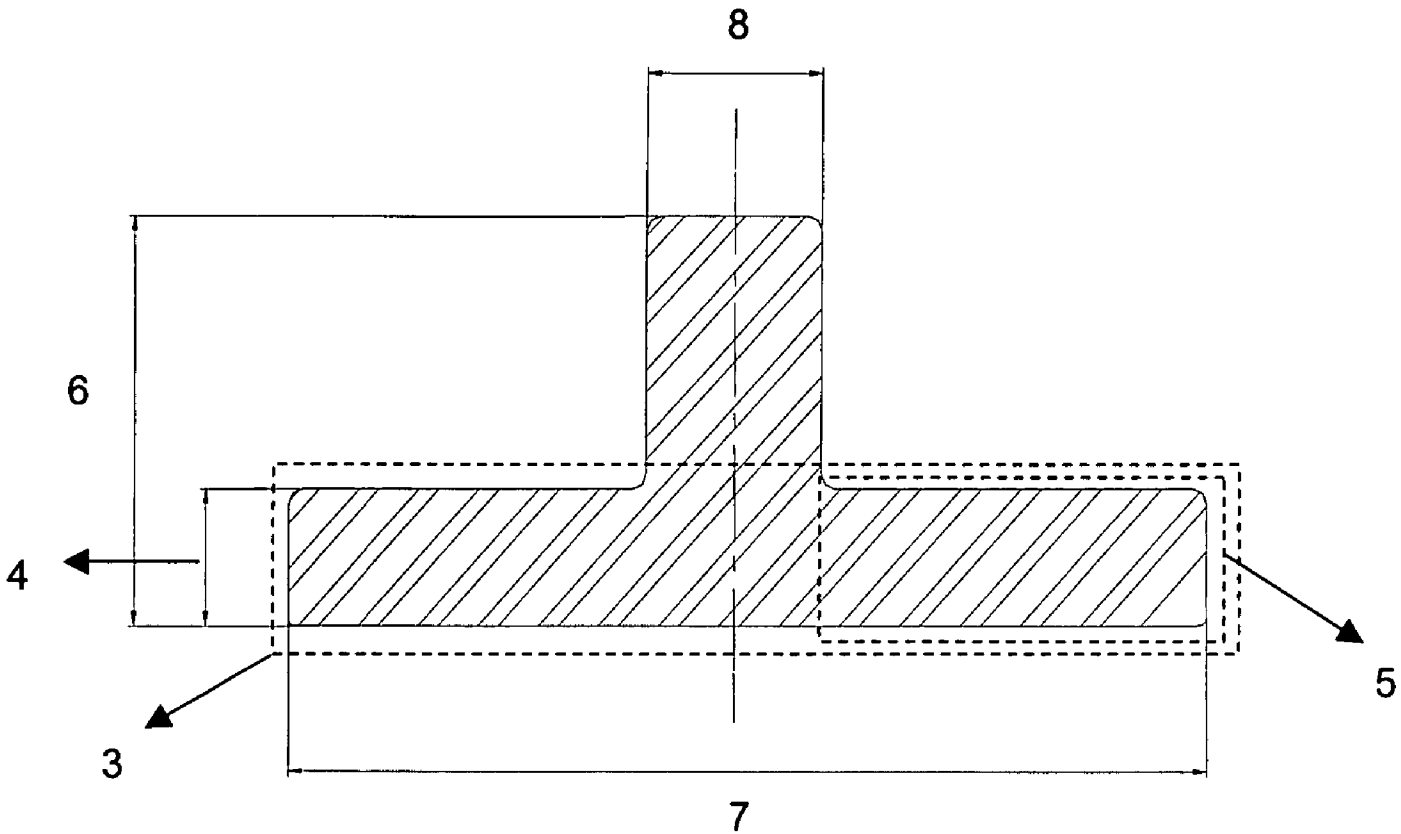
FIG. 3 shows a section of "inverse T"—-shape profiles, the manufacture of which is described in example 4.

Sections with different geometries were extruded starting from billets with composition A (see example 1). FIG. 2 shows the shape of these sections. The manufacturing process was similar to that described in example 1. Table 9 shows the static mechanical characteristics obtained for different annealing conditions. The first annealing step was still 6 hours at 120° C.

TABLE 9

| Duration of the 2nd annealing step at 160° C. | TEQ | $R_{m(L)}$ [MPa] | $R_{p0.2(L)}$ [MPa] | $A_{(L)}$ [%] | EXCO surface | EXCO T/2 |
|---|---|---|---|---|---|---|
| 1 hour | 1.77 | 635 | 595 | 11 | pitting | ED+ |
| 2 hours | 2.77 | 634 | 600 | 11 | pitting | ED+ |
| 3 hours | 3.77 | 632 | 602 | 9 | pitting | ED |
| 4 hours | 4.71 | 628 | 601 | 11 | pitting | ED |
| 8 hours | 8.71 | 621 | 593 | 10 | pitting | EB |
| 16 hours | 16.71 | 597 | 559 | 10 | pitting | EA/EB |
| 32 hours | 32.71 | 541 | 482 | 11 | pitting | EA/EB |

Temper T6 is close to the 6 hours point at 120° C.+1 h at 160° C.

Table 10 shows some compromises between toughness and static mechanical characteristics for some points corresponding to T7x states:

TABLE 10

| | Duration of 2nd annealing step | | |
|---|---|---|---|
| | 8 h | 12 h | 24 h |
| TEQ | 8.71 h | 12.71 h | 24.71 |
| EXCO: surface | Pitting | Pitting | Pitting |
| EXCO: T/2 | EB | EB | EA/EB |
| $K_{app(L-T)}$ [MPa√m] | 86.4 | 83.1 | 80.0 |
| $R_{m(L)}$ [MPa] | 619 | 614 | 576 |
| $R_{p0.2(L)}$ [MPa] | 588 | 577 | 522 |
| $A_{(L)}$ [%] | 12.5 | 10.9 | 11.7 |

TEQ: Equivalent annealing time at 160° C.
EXCO: resistance to exfoliation corrosion, determined by the EXCO test on surface; mid-thickness (T/2)

These sections were used for the production of fuselage frames.

Additional advantages, features and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

The invention claimed is:

1. A structural element suitable for aeronautical construction made from at least one extruded product comprising an aluminum alloy of the following composition (by mass):

(a) Zn 6.9-7.3% Cu 2.0-2.8% Mg from 1.6 to less than 2.0% wherein Cu/Mg is at least 1.1

(b) at least one element selected from the group consisting of: Zr 0.08-0.20%, Cr 0.05-0.25%, Sc 0.01-0.50% Hf 0.05-0.60% and V 0.02-0.20%

(c) Fe+Si<0.20%

(d) other elements ≦0.05% each and ≦0.15% total, (e) remainder aluminum, wherein said product possesses at least one of the following sets of properties measured at about 20° C.:

(a) a yield stress $R_{p0.2(L)}$ equal to at least 580 MPa and a measured $K_{app(L-T)}$ with W=100 mm equal to at least about 80 MPa√m;

(b) a yield stress $R_{p0.2(L)}$ equal to at least 580 MPa and a crack propagation rate da/dn not exceeding about $3\times10^{-3}$ mm/cycle for ΔK=27 MPa√m;

(c) a yield stress $R_{p0.2(L)}$ equal to at least 580 MPa, an ultimate strength $R_{m(L)}$ equal to at least 600 MPa and a $K_{app(L-T)}$ measured with W=100 mm equal to at least about 80 MPa√m;

(d) an ultimate strength Rm(L) equal to at least 600 MPa and a $K_{app(L-T)}$ measured with W=100 mm equal to at least about 80 MPa√m.

2. A structural element according to claim 1, wherein 3.8<(Cu+Mg)<4.8.

3. A structural element of claim 1, wherein 3.9<(Cu+Mg)<4.7.

4. A structural element of claim 1, wherein 4.1<(Cu+Mg)<4.7.

5. A structural element according to claim 1, wherein a Cu/Mg ratio in the composition is between 1.1 and 1.5.

6. A structural element according to claim 1, wherein Cu is between 2.2 and 2.6%.

7. A structural element according to claim 1, wherein Mg is from 1.7 to less than 2.0%.

8. A structural element according to claim 1, further comprising up to 0.8% of manganese.

9. A structural element according to claim 1, wherein the sum of the contents of the Zr, Cr, Sc, Hf, V and Mn elements does not exceed about 1.0%.

10. A structural element according to claim 1, wherein Si+Fe does not exceed 0.15%.

11. A structural element according to claim 1, wherein said product has been put into solution, quenched and annealed, by achieving a first plateau at a temperature of between about 110° C. and about 125° C., and a second plateau at a temperature of between about 150 and about 170° C.

12. A structural element according to claim 1, further possessing at least one property selected from the group consisting of:

(a) elongation at failure $A_{(L)}$ equal to at least about 9%, and (b) resistance to exfoliation corrosion measured according to ASTM G34 equal to at least about EB.

13. A structural element according to claim 1, wherein the value of $K_{app(L-T)}$ at about −50° C. is at least about 98%, of a value measured at about 20° C.

14. A structural element according to claim 1, comprising a wing stiffener obtained by extrusion.

15. A structural element according to claim 1, comprising a fuselage frame stiffener.

16. A method for manufacturing an extruded product according to claim 1, said method comprising:

(a) preparing said alloy, (b) casting an as-cast product, (c) homogenizing said as-cast product, (d) hot transforming to obtain a first intermediate product, (e) causing dissolution of said first intermediate product, (f) quenching, (g) optionally conducting controlled tension, and (h) annealing.

17. A method according to claim 16, wherein said method involves homogenizing in at least two steps, with a first plateau between about 452 and about 473° C., and a second plateau between about 465 and about 484° C.

18. A method according to claim 16, wherein said hot transforming is carried out by extrusion at a temperature measured at a die utilized in said extrusion of between about 380° C. and about 430° C.

19. A method according to claim 16, wherein the temperature during said dissolution does not exceed 485 ° C.

20. A method according to claim 19, wherein said dissolution is terminated by a plateau between about 470 and about 485° C., for a duration of between about 1 and about 10 hours.

21. A method according to claim 16, wherein the controlled tension leads to a permanent elongation between about 1 and about 5%.

22. A method according to claim 16, wherein the annealing comprises:

a) a first plateau at a temperature of between about 110° C. and about 130° C.; and b) a second plateau at a temperature of between about 150° C. and about 170° C.

23. A structural element of claim 1 that is situated in an aeronautical construction.

24. A structural element suitable for aeronautical construction made from at least one extruded product comprising an aluminum alloy of the following composition (by mass):

(a) Zn 6.9-7.3% Cu 2.0-2.8% Mg from 1.6 to less than 2.0% wherein Cu/Mg is at least 1.1

(b) at least one element selected from the group consisting of: Zr 0.08-0.20% Cr 0.05-0.25% Sc 0.01-0.50% Hf 0.05-0.60% and V 0.02-0.20%

(c) Fe+Si<0.20%

(d) other elements ≦0.05% each and ≦0.15% total, (e) remainder aluminum, wherein said product possesses the following set of properties measured at about 20° C.:

(f) a yield stress $R_{p0.2(L)}$ equal to at least 580 MPa, (ii) an ultimate strength $R_{m(L)}$ equal to at least 600 MPa and (iii) a $K_{IC(L-T)}$ equal to at least 31 MPa√m.

25. A structural element suitable for aeronautical construction made from at least one extruded product comprising an aluminum alloy of the following composition (by mass):

(a) Zn 6.9-7.3% Cu 2.0-2.8% Mg from 1.6% to less than 2.0% wherein Cu/Mg is at least 1.1

(b) at least one element selected from the group consisting of: Zr 0.08-0.20% Cr 0.05-0.25%Sc 0.01-0.50% Hf 0.05-0.60% and V 0.02-0.20%

(c) Fe +Si<0.20%

(d) other elements ≦0.05% each and ≦0.15% total, (e) remainder aluminum, wherein said product possesses the following set of properties measured at about 20° C.:

(a) a yield stress $R_{P0.2(L)}$ equal to at least 580 MPa, and a measured $K_{appl(L-T)}$ with W=100 equal to at least about 80 Mpa√m;

(b) a yield stress $R_{P0.2(L)}$ equal to at least 580 MPa and a crack propagation rate da/dn not exceeding about $3\times10^{-3}$ mm/cycle for ΔK=27 MPa√m;

(c) a yield stress $R_{P0.2(L)}$ equal to at least 580 MPa, an ultimate strength $R_{m(L)}$ equal to at least 600 MPa and a $K_{appl(L-T)}$ measured with W=100 mm equal to at least about 80 MPa√m.

26. A structural element of claim 1 that is used as wing stiffener.

27. A structural element suitable for aeronautical construction made from at least one extruded product comprising an aluminum alloy of the following composition (by mass):

(a) Zn 6.9-7.3% Cu 2.0-2.8% Mg 1.8-1.91% wherein Cu/Mg is at least 1.1

(b) at least one element selected from the group consisting of: Zr 0.08-0.20% Cr 0.05-0.25%, Sc 0.01-0.50% Hf 0.05-0.60% and V 0.02-0.20%

(c) Fe +Si<0.20%

(d) other elements ≦0.05% each and ≦0.15% total, (e) remainder aluminum, wherein said product possesses the following set of properties measured at about 20° C.:

(a) a yield stress $R_{p0.2(L)}$ equal to at least 580 MPa, and a measured $K_{appl(L-T)}$ with W=100 mm equal to at least about 80 Mpa√m;

(b) a yield stress $R_{p0.2(L)}$ equal to at least 580 MPa and a crack propagation rate da/dn not exceeding about $3\times10^{-3}$ mm/cycle for ΔK=27 MPa√m;

(c) a yield stress $R_{p0.2(L)}$ equal to at least 580 MPa, an ultimate strength $R_{m(L)}$ equal to at least about 580 MPa and a $K_{appl(L-T)}$ measured with W=100 mm equal to at least about 80 MPa√m;

(d) an ultimate strength $R_{m(L)}$ equal to at least 600 MPa and a $K_{app(L-T)}$ measured with W=100 mm equal to at least about 80 MPa√m.

28. A structural element of claim 27, wherein Mg is about 1.9%.

29. A structural element of claim 24, wherein Mg is from 1.6-1.91%.

30. A structural element of claim 24, wherein Mg is about 1.9%

31. A structural element suitable for aeronautical construction made from at least one extruded product comprising an aluminum alloy of the following composition (by mass):

(a) Zn 6.9-7.3% Cu 2.0-2.8% Mg from 1.6 to less than 2.0% wherein Cu/Mg is at least 1.1

(b) at least one element selected from the group consisting of: Zr 0.08-0.20%, Sc 0.01-0.50% Hf 0.05-0.60% and V 0.02-0.20%

(c) Fe+Si<0.20%

(d) other elements≦0.05% each and≦0.15% total, (e) remainder aluminum, wherein said product possesses the following set of properties measured at about 20 C.: a yield stress $R_{p0.2(L)}$ equal to at least 580 MPa, an ultimate strength $R_{m(L)}$ equal to at least 600 MPa and a measured $K_{app(L-T)}$ with W=100 mm equal to at least about 80MPa√m and a $K_{IC(L-T)}$ equal to at least 31 MPa√m.

* * * * *